United States Patent [19]

Goldberg

[11] 4,437,276

[45] Mar. 20, 1984

[54] METHOD AND DEVICE FOR THE PERFORMANCE OF A SUPPORTING FUNCTION IN A PASSAGE

[76] Inventor: Jurgen Goldberg, Mittelweg 15, D-7801 Umkirch, Fed. Rep. of Germany

[21] Appl. No.: 307,082

[22] Filed: Sep. 29, 1981

[30] Foreign Application Priority Data

Oct. 2, 1980 [DE] Fed. Rep. of Germany ..... 3037177

[51] Int. Cl.[3] ..... E04B 1/41

[52] U.S. Cl. ..... 52/125.5

[58] Field of Search ..... 52/125.3, 125.4, 125.5, 52/704, 707; 411/34–38, 30, 55, 24, 388, 389, 412, 413

[56] References Cited

U.S. PATENT DOCUMENTS

| | | | |
|---|---|---|---|
| 323,022 | 7/1885 | Boone | 411/24 |
| 1,062,534 | 5/1913 | Butler | 411/55 |
| 1,963,301 | 6/1934 | Gloystein | 411/30 |
| 2,217,560 | 10/1940 | Michon | 52/223 L |
| 3,013,643 | 12/1961 | Perry | 411/34 |
| 3,489,312 | 1/1970 | Hunckler et al. | 411/34 |
| 4,017,115 | 4/1977 | Holt et al. | 52/125.5 |
| 4,068,879 | 1/1978 | Torbet et al. | 52/125.5 |

FOREIGN PATENT DOCUMENTS

| | | | |
|---|---|---|---|
| 188489 | 1/1957 | Austria | 411/55 |
| 510011 | 2/1955 | Canada | 411/34 |

*Primary Examiner*—James L. Ridgill, Jr.
*Attorney, Agent, or Firm*—Peter K. Kontler

[57] ABSTRACT

A device for the performance of a supporting function in a passage includes a resilient plug which is expandible to the cross-sectional area of the passage and contractible to a lesser cross-sectional area. Contraction of the plug after its supporting function has been completed permits the plug to be readily withdrawn from the passage. The device is particularly useful for forming a passage in an element composed of a flowable and hardenable material such as concrete. The material is poured around the plug and the plug is contracted and withdrawn from the material once this has hardened.

49 Claims, 7 Drawing Figures

33
8
34

16
1
9
15
31
6
21
2
26
11
27
27
7
3
4
17
12
4
2
5

METHOD AND DEVICE FOR THE PERFORMANCE OF A SUPPORTING FUNCTION IN A PASSAGE

BACKGROUND OF THE INVENTION

The invention relates generally to a method and device for the performance of a supporting function in a passage. Although a particular aspect of the invention is directed to a method and device for forming a passage in an element made of a flowable and hardenable material, e.g., concrete or the like, the invention also encompasses the performance of other supporting functions in a passage.

It is frequently necessary to provide a passage in an element cast from concrete. In particular, an element cast from concrete often requires a passage for anchoring a lifting member to transport and/or mount the element.

A known lifting member has a shaft which extends into the interior of the concrete element in a direction generally perpendicular to a surface of the element. The end of the shaft inside the element is provided with an anchor which releasably engages the concrete element. The passage for the lifting member is lined with a hollow member which conforms to the contour of the lifting member and extends into the interior of the concrete element in a direction perpendicular to the above-mentioned surface of the element.

In order to define the passage for the lifting member and to prevent the hollow member from being filled during pouring of the concrete, it has become known to insert a resilient, one-piece plug in the hollow member prior to pouring. A screw extends through the plug and is operative to compress the plug axially so that the plug is pressed against the walls of the hollow member and thereby seals the same (see, for example, DE-OS No. 1961 879). The plug is intended to be removable after the concrete has set.

It has been found that considerable difficulties are encountered during removal of the resilient plug. Thus, once the concrete has been poured, the plug becomes fixed in the hollow member in such a manner that the screw which extends through the plug and is to be used in removing the plug further compresses the same. This causes the plug to be pressed against the walls of the hollow member more forcefully. Accordingly, the removal of such a resilient, one-piece plug cannot always be performed in a satisfactory manner, e.g. it may be necessary to destroy the plug in order to expose the anchoring passage.

It is further known to seal the hollow member with a three-piece shaft or the like. One of the sections of a plug of this type is in the form of a wedge which is removed during disassembly. Plugs of this type are not only expensive and difficult to handle but require substantial forces to separate the individual sections from one another. Moreover, such plugs are not effective for sealing the hollow member against the fine particles which accumulate in the region of the hollow member during setting of the concrete. Other difficulties also arise on occasion when using plugs having multiple sections.

OBJECTS AND SUMMARY OF THE INVENTION

It is an object of the invention to provide a device for the performance of a supporting function in a passage which may be readily inserted into and removed from the passage.

Another object of the invention is to provide a device for the performance of a supporting function in a passage which is relatively inexpensive.

An additional object of the invention is to provide a device for the performance of a supporting function in a passage which is easy to handle.

It is also an object of the invention to provide a device for the performance of a supporting function in a passage which does not require excessive forces for the operation thereof.

Yet another object of the invention is to provide a device for the performance of a supporting function in a passage which is capable of providing a good seal.

A concomitant object of the invention is to provide an improved device for forming a passage in an element made from a flowable and hardenable material, e.g. concrete. The improved device is intended to be readily removable from the passage and to make it possible to form the passage at low cost while nevertheless affording good protection against penetration of material into the passage. The improved device is further intended to be reusable and, where the element is to contain a hollow member, to maintain the position of the hollow member, and consequently of the passage, with the necessary precision during pouring.

Still another object of the invention is to provide a method for forming a passage in an element made of a flowable and hardenable material, e.g. concrete, which enables the passage to be produced at low cost.

It is yet another object of the invention to provide a method for forming a passage in an element made of a flowable and hardenable material, e.g. concrete, which enables the passage to be produced without the expenditure of excessive effort and time.

These objects, and others which will become apparent as the description proceeds, are achieved by the invention.

One aspect of the invention resides in a device for performing a supporting function in a passage having an open end of predetermined cross-sectional area. The device comprises a plug which is expandible to this predetermined cross-sectional area and contractible to a lesser cross-sectional area.

Another aspect of the invention resides in a method of making an element having a passage. The method involves surrounding a plug with a flowable and hardenable material and hardening the material. The cross-sectional area of the plug is reduced to form a gap between the plug and the material and the plug is then withdrawn from the material.

In accordance with the invention, the cross-sectional area of the plug may be reduced below that of the passage when the plug is to be withdrawn from the passage. When the device is used to form a passage, e.g. an anchoring passage, in an element which is to contain a hollow member, the plug can provide sufficient support internally of the hollow member to maintain the configuration of the latter during the production process. On the other hand, since the cross-sectional area of the plug may be reduced below that of the hollow member, the plug may be readily withdrawn from the hollow member and reused many times.

The plug may likewise be used to form a passage, e.g. an anchoring passage, in an element which does not contain a hollow member or in which the hollow member only extends along a portion of the passage. Here, also, the ability to reduce the cross-sectional area of the plug makes removal thereof a relatively simple matter.

According to a particularly favorable embodiment of the invention, the plug is provided with an adjusting member which serves to change the cross-sectional area of the plug. The adjusting member advantageously engages the plug at least in the region of the outer end of the plug, that is, the end of the plug adapted to be located in the vicinity of the outer end of the passage. The adjusting member may, for instance, operate to increase the axial length of the plug when this is to be withdrawn from the passage and thereby reduce the cross-sectional area of the plug.

In accordance with another embodiment of the invention, the plug is provided with a pair of internally threaded sleeves which are respectively arranged in the region of the outer end of the plug and the region of the inner end of the plug, that is, the end of the plug adapted to be located internally of the passage. The adjusting member here includes a bolt having a pair of externally threaded portions which respectively mate with the sleeves. The two sleeves are differently threaded so that a predetermined rotation of the bolt causes the threaded portions to advance by different amounts and/or in different directions. Depending upon the direction of rotation of the bolt, this makes it possible to lengthen or shorten the plug in axial direction thereof and to effect a corresponding reduction or increase in the cross-sectional area of the plug.

An additional embodiment of the invention provides for the plug to have a pair of parallel sides. Such a plug may be used to advantage even without a hollow member to form a passage having parallel sides in a poured or cast element.

A substantial advantage of the invention resides in that the plug, and consequently the passage formed by the plug, may have a cylindrical, prismatic or other cross-sectional configuration and that the plug may nevertheless be readily withdrawn from the passage. Although it is true that a plug may always be readily removed from a passage by using a conical plug to form a conical passage increasing in diameter from the inside towards the outside, such a conical passage is frequently undesired for various reasons.

The device of the invention may also be used as a spacer and/or seal. By way of example, the device may be accommodated between a pair of spaced plates or walls provided with at least one opening through which the device may be inserted into the gap between the plates or walls. Here, the cross-sectional area of the plug is reduced so that it may be passed through the opening. Once the plug has been inserted into the gap between the plates or walls, the plug is expanded so that its cross-sectional area becomes larger than that of the opening. The plug now engages the inner surface of the plate or wall with the opening around the periphery of the opening while it engages the inner surface of the other plate or wall at a location opposite the opening. The plug thus serves as a spacer between the plates or walls and as a seal for the opening.

The novel features which are considered as characteristic of the invention are set forth in particular in the appended claims. The improved device itself, however, both as to its construction and its mode of operation, together with additional features and advantages thereof, will be best understood upon perusal of the following detailed description of certain specific embodients with reference to the accompanying drawing.

DESCRIPTION OF THE PREFERRED EMBODIMENTS

Figure 1:
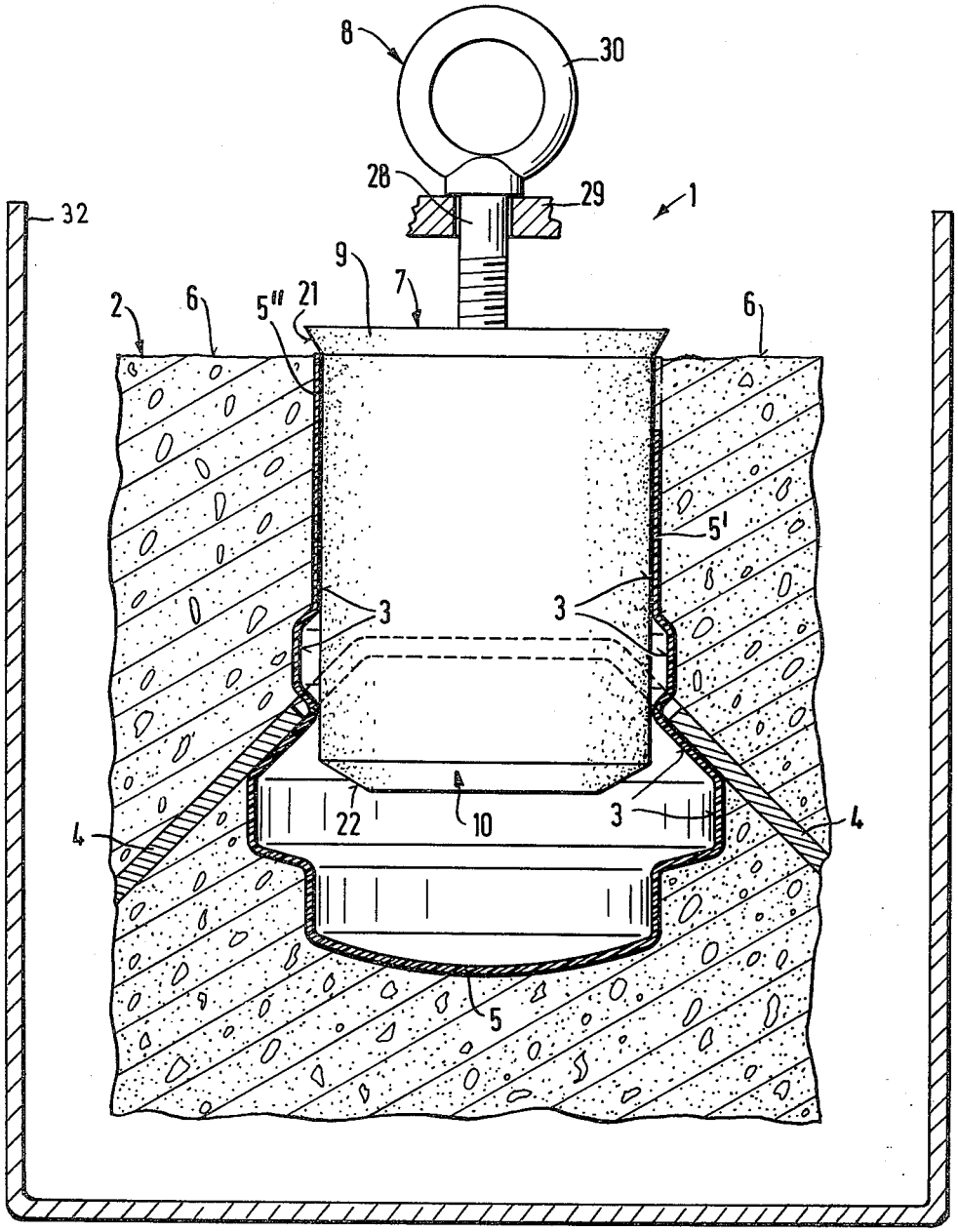
FIG. 1 is a partly cross-sectional view illustrating the formation of a passage in a concrete element using one embodiment of a device according to the invention.

FIG. 1 schematically illustrates the production of a plate-like concrete element 2 in a mold 32. The concrete element 2 has a passage 3 which is to anchor a non-illustrated lifting member for transporting the concrete element 2. A reinforcing plate 4 is provided in the concrete element 2 and is arranged to absorb at least part of the force transmitted to the concrete element 2 from the lifting member.

The passage 3 is lined with a hollow member 5. If necessary, the hollow member 5 may extend all the way to the upper surface 6 of the concrete element 2 as indicated by the reference numeral 5" on the left-hand side of the passage 3. However, since the hollow member 5 is a so-called "lost" component which remains in the concrete element 2, it may terminate below the upper surface 6 of the concrete element 2 in order to save material. This is indicated by the reference numeral 5' on the right-hand side of the passage 3.

The contour of the hollow member 5 corresponds to the contour of the passage 3 and is that which is desired for anchoring purposes. The hollow member 5 is generally composed of a thin-walled synthetic resin since it may then be produced relatively easily and inexpensively. The contoured lower portion of the hollow member 5 may be provided with stiffening ribs if required. This may be necessary, for example, if the contoured lower portion of the hollow member 5 is not supported internally in some manner.

A device identified generally by the reference numeral 1 serves to form the passage 3 in the concrete element 2. The device 1 includes a plug 7 which is accommodated in the hollow member 5 and supports the same internally.

The inner end 10 of the plug 7 or, in other words, the end of the plug 7 located internally of the passage 3, has an inwardly beveled portion 22 which facilitates insertion of the plug 7 into the hollow member 5. Similarly, the outer end 9 of the plug 7, that is, the end of the plug 7 located in the region of the open end of the passage 3, is provided with an outwardly beveled portion 21 which greatly simplifies withdrawal of the plug 7 from the passage 3 and also assists in insertion of the plug 7 into the hollow member 5. The outwardly beveled portion of the plug 7 projects radially outwards of the latter to a limited extent.

In operation, the hollow member 5 is placed in the mold 32 at the location where the passage 3 is to be formed. The plug 7, which has the same cross-sectional configuration as the upper portion of the hollow member 5, is inserted into the hollow member 5 and frictionally engages the same. Concrete is now poured into the mold 32 as necessary to form the concrete element 2. It will be understood that the reinforcing plate 4 is placed in the mold 32 as appropriate. The plug 7 supports the hollow member 5 internally and prevents the same from collapsing under the pressure of the concrete. The plug 7 remains in the hollow member 5 until at least such time as the concrete has set sufficiently to prevent the danger of collapse of the hollow member 5.

Once the concrete has set sufficiently, the plug 7 is removed from the passage 3. To this end, the device 1 is designed such that the cross-sectional area of the plug 7 can be reduced below that of the surrounding portion of the hollow member 5.

In accordance with one feature of the invention, the plug 7 is composed of a resilient material such as, for example, rubber. The plug 7 is provided with an adjusting member 8 for changing the cross-sectional area thereof. The adjusting member 8 includes a member or handle 30 for engaging the same. The member 30 is here in the form of a ring but could also be in the form of a hook or other suitable component. The adjusting member 8 further has a retaining or arresting member 28 which engages a supporting member 29. The supporting member 29 is fixed and may, for example, be secured to the mold 32. The supporting member 29 arrests the plug 7 so that the latter, in turn, forms a stable support for the hollow member 5. This assures that the passage 3 will be located at its intended position within the required tolerances.

According to one embodiment of the invention, the adjusting member 8 engages the plug 7 at least in the region of the outer end 9 thereof. The device 1 is here constructed in such a manner that the application of a force to the adjusting member 8 in a direction tending to remove the plug 7 from the passage 3 causes elongation of the plug 7 in axial direction thereof. As a result, the cross-sectional area of the plug 7 decreases so that the plug 7 becomes disengaged from the wall of the passage 3 and can be readily removed from the latter.

The plug 7 may also be designed in such a manner that the cross-sectional area of the plug 7 in the normal or undeformed condition thereof is sufficiently less than that of the passage 3 to enable easy removal of the plug 7 from the passage 3. In such an event, removal of the plug 7 from the passage 3 may be accomplished without an extension of the plug 7 beyond its normal or undeformed length and an accompanying contraction of the plug 7 to below its normal or undeformed cross-sectional area. The adjusting member 8 is then constructed to axially compress the plug 7 and thereby increase the cross-sectional area thereof. In this manner, the plug 7 can be expanded into engagement with the hollow member 5 so as to provide the requisite support internally of the latter during pouring and hardening of the concrete element 2. When the plug 7 is to be removed from the passage 3, the adjusting member 8 is manipulated so as to cause the plug 7 to assume its normal cross-sectional area thereby permitting the plug 7 to be readily withdrawn from the passage 3.

Figure 2:
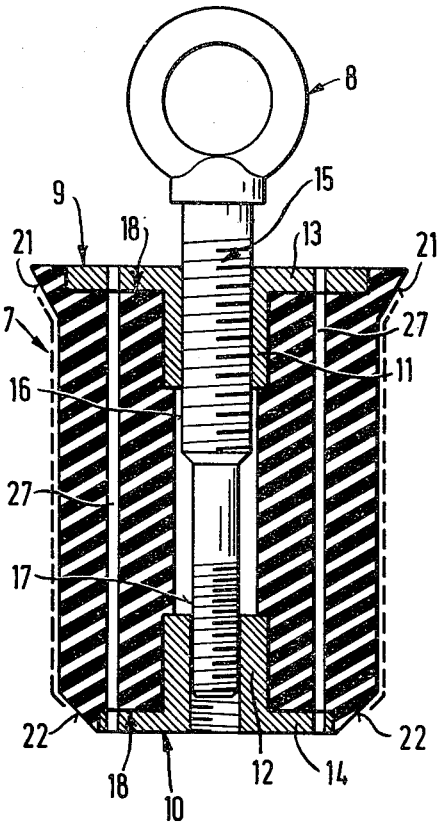
FIG. 2 is a cross-sectional view of another embodiment of a device in accordance with the invention.
Figure 3:
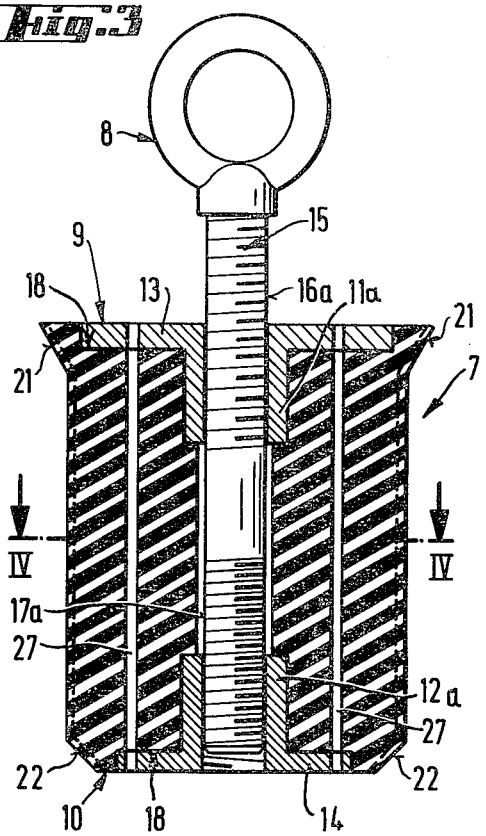
FIG. 3 is a cross-sectional view of a further embodiment of a device according to the invention.

FIGS. 2 and 3, where the same reference numerals as in FIG. 1 have been used to identify similar components, illustrate particularly advantageous embodiments of the invention. Here, the adjusting member 8 engages the plug 7 in the regions of the outer end 9 and inner end 10 thereof via intermediate or bearing members.

Referring first to FIG. 2, it may be seen that the intermediate or bearing members are in the form of sleeves 11 and 12. The sleeve 11 is mounted in the region of the outer end 9 of the plug 7 while the sleeve 12 is mounted in the region of the inner end 10 of the plug 7. The sleeves 11 and 12 have respective flanges 13 and 14 which are connected with the plug 7 in such a manner that tensile forces can be transmitted between the plug 7 and the sleeves 11 and 12. The flanges 13 and 14 are advantageously in surface-to-surface contact with the plug 7 and connected therewith via suitable bonds e.g. adhesive bonds, over substantially the entire contact areas 18. For instance, if the plug 7 is composed of rubber and the sleeves 11 and 12 are made of metal as shown, the flanges 13 and 14 are favorably connected with the plug 7 over the areas 18 by rubber-to-metal adhesive bonds.

The adjusting member 8 includes a bolt 15 having a threaded portion 16 which mates with the sleeve 11 and a threaded portion 17 which mates with the sleeve 12. The portions 16 and 17 of the bolt 15, and hence the respective sleeves 11 and 12, are threaded differently so that the portions 16 and 17 advance by different amounts during each rotation of the adjusting member 8. This makes it possible to lengthen the plug 7, and thereby reduce the cross-sectional area thereof as illustrated by the dashed lines in FIG. 2, by turning the adjusting member 8 in the appropriate direction. On the other hand, the plug 7 may be compressed, and the cross-sectional area thereof increased, by turning the adjusting member 8 in the opposite direction. The plug 7 may be designed so that it is in an undeformed condition when shortened axially and expanded radially to the dashed line configuration.

In the embodiment of FIG. 2, the different leads, that is, distances of advance, of the portions 16 and 17 of the bolt 15 is achieved in that the threads of the portions 16 and 17, and hence of the respective sleeves 11 and 12, have the same pitch but different diameters.

FIG. 3 is the same as FIG. 2 except that the sleeves 11 and 12 of FIG. 2 are replaced by sleeves 11*a* and 12*a* having identical thread diameters. Likewise, the bolt 15 of FIG. 3 is provided with threaded portions 16*a* and 17*a* having the same thread diameter. In the embodiment of FIG. 3, different leads for the threaded portions 16*a* and 17*a* of the bolt 15 are achieved by making the pitch of the threaded portion 16*a* and its corresponding sleeve 11*a* different from that of the threaded portion 17*a* and its corresponding sleeve 12*a*. The threaded portion 16*a* and sleeve 11*a* may also have a different thread depth than the threaded portion 17*a* and sleeve 12*a*. As indicated by the dashed lines in FIG. 3, the adjusting member 8 has been rotated in a direction opposite to that in FIG. 2 so that the plug 7 is compressed and its cross-sectional area is increased.

In FIG. 2, the threaded portions 16 and 17 of the bolt 15 and the respective sleeves 11 and 12 have the same pitch but different thread diameters. In FIG. 3, on the other hand, the threaded portions 16*a* and 17*a* of the bolt 15 and the corresponding sleeves 11*a* and 12*a* have the same thread diameter but different pitches. It is also possible to combine different thread diameter with different pitch. In addition, one of the threaded portions, e.g. 16, may be provided with a single thread while the other threaded portion, e.g. 17, may be provided with multiple threads having different pitches. Furthermore, while the respective threads of FIGS. 2 and 3 are assumed to have the same orientation, it is likewise possible to provide one of the threaded portions of the bolt 15, as well as the associated sleeve, with a right-handed thread and to provide the other threaded portion and its associated sleeve with a left-handed thread. The primary consideration is that the threaded portions of the bolt 15 advance differently, i.e. by different amounts and/or in different directions, during each rotation of the adjusting member 8. The magnitude of the difference between the distances of advance of the threaded portions of the bolt 15 determines the change in cross-sectional area of the plug 7 per rotation of the adjusting member 8 and thereby also the pressure exerted by the plug 7 for a given force applied to the adjusting member 8.

It is apparent from the preceding description of FIGS. 2 and 3 that the members 7, 8, 11 and 12, or 7, 8, 11*a* and 12*a*, together constitute a machine element which is capable of undergoing a change in cross-sectional area within predetermined limits by manipulation of the adjusting member 8.

It will be understood that structural means other than different threads as in FIGS. 2 and 3 may be used to achieve compression and extension of the plug 7 and a corresponding change in the cross-sectional area thereof. By way of example, it is possible to provide the device 1 with inclined surfaces and arresting cams.

With reference still to FIGS. 2 and 3, it will be seen that the cross-sectional areas of the sleeves 11, 11*a* and 12, 12*a* are smaller than the cross-sectional area of the plug 7 so that the sleeves 11, 11*a* and 12, 12*a* are accommodated entirely within the plug 7. As a result, the outer surfaces of the plug 7 are essentially continuous. This is especially favorable when, as will be described later, the plug 7 is used as a spacer or retainer or directly as a mold member for forming a passage.

The plug 7 is provided with a pair of axially extending venting channels 27. The venting channels 27 facilitate insertion of the plug 7 into the hollow member 5 and also prevent the creation of a vacuum in the passage 3 which could hinder the withdrawal of the plug 7 therefrom.

Figure 4:
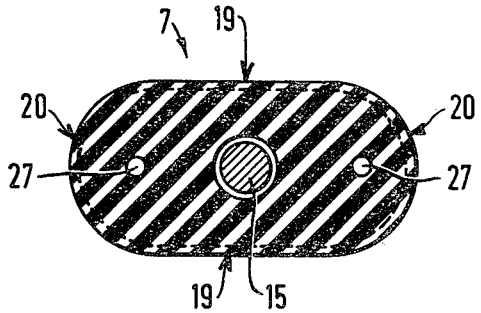
FIG. 4 is a view in the direction of the arrows IV—IV of FIG. 3.

FIG. 4 illustrates a particularly advantageous configuration for the plug 7. Here, the plug 7 generally resembles a cylinder and has a pair of parallel sides 19 which are connected by a pair of semi-circular sides 20. A plug 7 of this type is of particular advantage since it may be used to form passages having parallel side walls. Due to the invention, the plug 7 and the passage 3 need not widen conically from the inside to the outside of an element in order for the plug 7 to be readily removable from the passage 3. This is an advantage since conical passages have various drawbacks and are frequently undesired. Nevertheless, there are occasions when a conical passage is required and the plug 7 may then have a conical configuration. The invention is of advantage even for a conical passage since the contraction of the plug 7 when it is to be withdrawn from the passage enables frictional forces to be eliminated at least to a large extent. In fact, by making the plug 7 sufficiently deformable, it is even possible to use the plug 7 for the formation of passages which are undercut or decrease in cross-sectional area from the interior to the surface of an element. For instance, it is possible to form a passage using a conical plug 7 having an outer end of smaller diameter than the inner end thereof.

Referring once more to FIGS. 2 and 3, it will be noted that the lateral expansion and contraction of the plug 7 are substantially uniform along virtually the entire length thereof. Thus, the parallelism of the sides 19 of the plug 7 is maintained in both the elongated and compressed conditions of the plug 7. This is particularly important when, as will be described later, the plug 7 itself is used as a mold member. Although the presence of the flanges 13 and 14 may cause the lateral expansion and contraction characteristics in the regions of the outer end 9 and inner end 10 of the plug 7 to be somewhat different from those in the remainder of the plug 7, the effects of the flanges 13 and 14 may be largely cancelled by designing and/or arranging the plug 7 so that the flanges 13 and 14 lie outside the range of interest.

Figure 5:
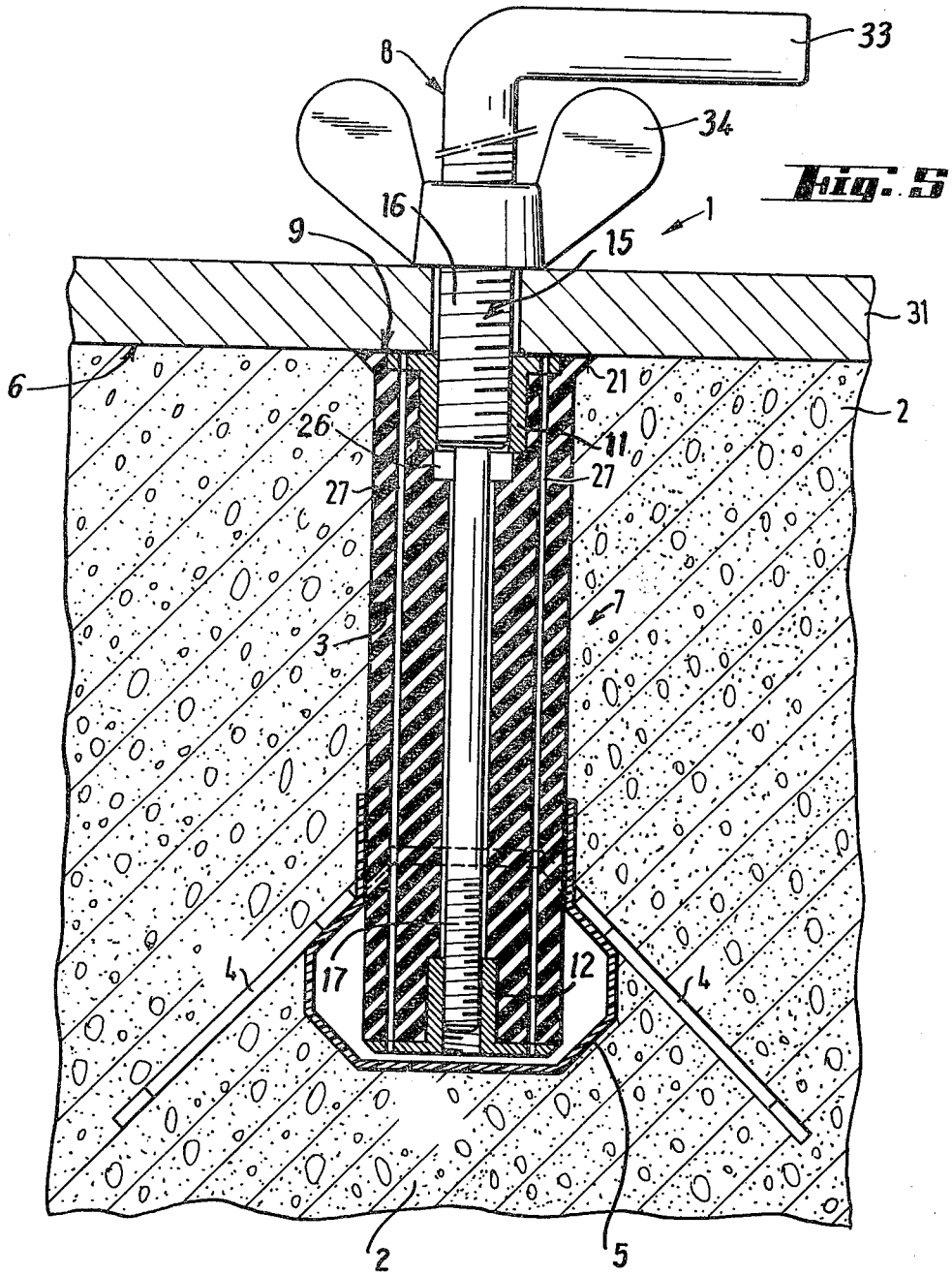
FIG. 5 is a cross-sectional view illustrating the formation of a passage in a concrete element using an additional embodiment of a device in accordance with the invention.

In FIG. 5, the same reference numerals as before have been used to identify like components. The device 1 here includes a plate 31 which rests on the upper surface 6 of the concrete element 2. The threaded portion 16 of the bolt 15 extends through the plate 31 and a wing nut 34 and terminates in a handle 33 for rotating the bolt 15. In contrast to the embodiments of FIGS. 2 and 3 where the entire length of the internal passage of the plug 7 connecting the sleeves 11 and 12 has a larger diameter than the threaded portion or 16*a* of the bolt 15, the internal passage of the plug 7 here has a smaller diameter than the threaded portion 16 of the bolt 15 over the major part of its length. Only the portion 26 of the internal passage of the plug 7 immediately adjacent to the threaded portion 16 has a diameter larger than that of the threaded portion 16 in order to permit the movement of the portion 16 necessary to effect compression and elongation of the plug 7.

The hollow member 5 shown in FIG. 5 terminates well below the upper surface 6 of the concrete element 2. The plug 7 is here in the form of an elongated cylinder and serves as a mold member to define the portion of the passage 3 between the upper end of the hollow member 5 and the upper surface 6 of the concrete element 2.

The beveled portion 21 of the outer end 9 of the plug 7 is here situated in the concrete element 2 so that a chamfer is formed in the concrete element 2 upon withdrawal of the plug 7 from the passage 3. The chamfer facilitates the introduction of an anchor into the passage 3.

Figure 6:
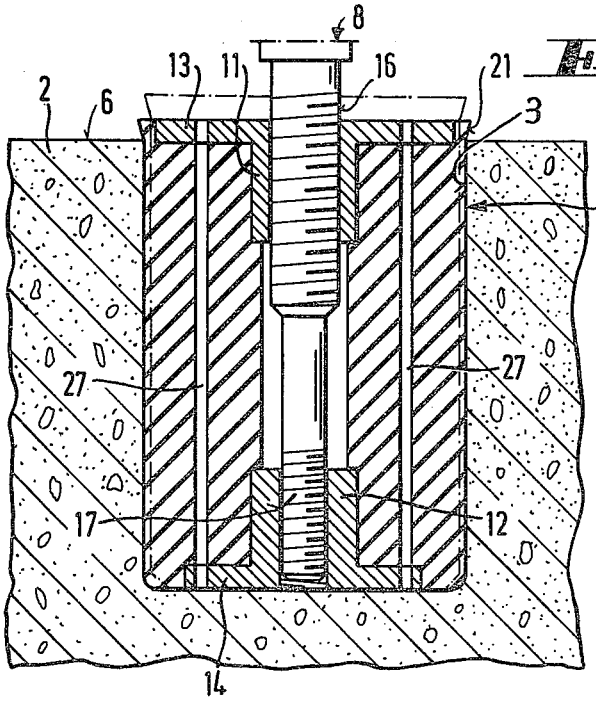
FIG. 6 is a cross-sectional view showing the use of the device of FIG. 2 for the formation of a passage in a concrete element.

FIG. 6 illustrates the use of the plug 7 to form a passage 3 in a concrete element 2 without a hollow member 5. The plug 7 here serves as a mold member of variable cross-sectional dimensions to form a passage 3 of predetermined dimensions in the concrete element 2.

Similarly to FIG. 1, the adjusting member 8 in FIG. 6 may be provided with an arresting member 28 for engagement with a fixed supporting member 29 to retain the plug 7 in position during pouring and hardening of the concrete element 2.

It is possible to use the plug 7 for the formation of passages in flowable and hardenable materials other than concrete. For example, the plug 7 may be used to form passages in an element composed of a synthetic resin which is flowable at or below room temperature. Furthermore, to the extent permitted by its temperature resistance, the plug 7 may be used to form passages in elements composed of a synthetic resin or other material which is flowable at an elevated temperature. If necessary, the outer surfaces of the plug 7 may be coated with a non-illustrated parting agent in order to avoid chemical adhesion of the plug 7 to the element being made.

It will be understood that several of the plugs 7 may be used simultaneously to form several passages in the concrete element 2. The plugs 7 may be arranged adjacent to one another or at substantial distances from one another and may be connected with each other, e.g. via components of the mold.

Figure 7:
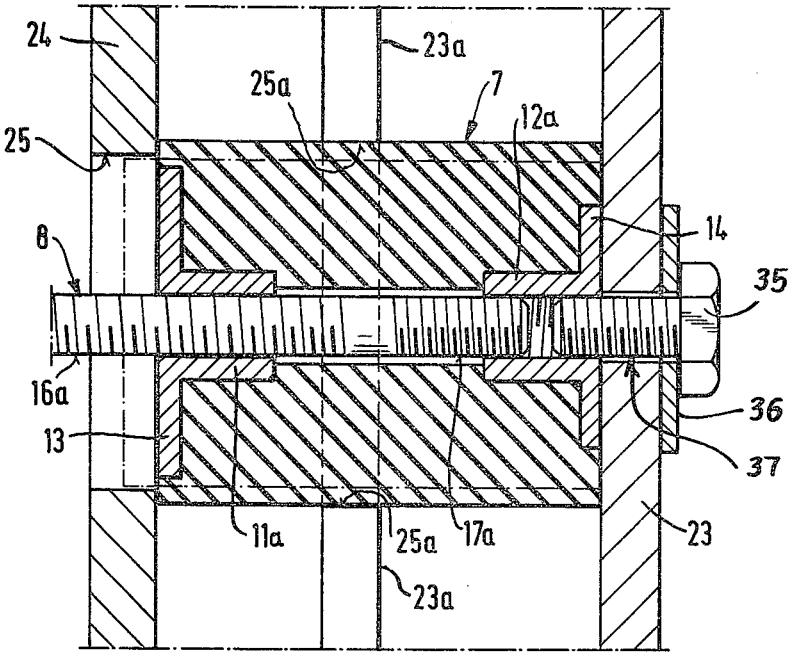
FIG. 7 is a cross-sectional view illustrating the use of the device of FIG. 3 as a spacer and seal.

FIG. 7 illustrates the use of the plug 7 as a spacer and seal between plate-like elements which are here assumed to be walls. A pair of walls 23 and 24 are arranged in parallelism with one another and with an intermediate wall 23*a* located between the walls 23 and 24. The wall 24 is provided with an opening 25 which provides access to the gap between the walls 23 and 24 while the wall 23*a* is provided with an opening 25*a* through which the plug 7 may be passed. The diameter of the opening 25*a* is somewhat larger than that of the opening 25.

In operation, the cross-sectional area of the plug 7 is reduced below that of the opening 25 and the plug 7 is inserted into the gap between the walls 23 and 24 via the openings 25 and 25*a*. The threaded sleeve 12*a* of the plug 7 is engaged by a bolt 35 which extends through a passage 37 in the wall 23 and bears against a plate 36 arranged on the outside surface of the wall 23. The cross-sectional area of the plug 7 is now increased to that of the opening 25*a*. The plug 7 thus seals the opening 25, holds the wall 23*a* in position and functions as a spacer between the walls 23 and 24.

It is noted that several of the plugs 7 may be arranged one behind the other on a bolt 15 of appropriate length.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for peforming a supporting function in a passage having an open end of predetermined cross-sectional area comprising:

(a) a plug which is expandable to said predetermined cross-sectional area and contractible to a lesser cross-sectional area, said plug having an outer end which is adapted to be located in the region of the open end of the passage and an inner end which is adapted to be located internally of the passage;

(b) an adjusting member for adjusting the cross-sectional area of said plug, said adjusting member engaging said plug in the regions of said outer and inner ends and being operative to lengthen and shorten said plug in axial direction thereof to thereby respectively reduce and increase the cross-sectional area of said plug, and said adjusting member having threaded portions in the regions of said outer and inner ends; and (c) threaded sleeves arranged in the regions of said outer and inner ends and receiving respective ones of said threaded portions, said threaded portions and threaded sleeves being designed in such a manner that a predetermined rotation of said adjusting member causes said threaded portions to advance by different amounts, and the respective sets of threaded portions and threaded sleeves having different thread diameters.

2. A device for performing a supporting function in a passage having an open end of predetermined cross-sectional area comprising:

(a) a plug which is expandable to said predetermined cross-sectional area and contractible to a lesser cross-sectional area, said plug having an outer end which is adapted to be located in the region of the open end of the passage and an inner end which is adapted to be located internally of the passage;

(b) an adjusting member for adjusting the cross-sectional area of said plug, said adjusting member engaging said plug in the regions of said outer and inner ends and being operative to lengthen and shorten said plug in axial direction thereof to thereby respectively reduce and increase the cross-sectional area of said plug, and said adjusting member having threaded portions in the regions of said outer and inner ends; and (c) threaded sleeves arranged in the regions of said outer and inner ends and receiving respective ones of said threaded portions, said threaded portions and threaded sleeves being designed in such a manner that a predetermined rotation of said adjusting member causes said threaded portions to advance by different amounts, and one of the sets of threaded portions and threaded sleeves having right-handed threads while the other set has left-handed threads.

3. A device as defined in claim 1, wherein the threads of the respective sets of threaded portions and threaded sleeves have the same orientation.

4. A device for performing a supporting function in a passage comprising:

(a) a resilient plug; and (b) adjusting means mounted on said plug and arranged to tension the latter along a predetermined direction so that said plug elongates in said predetermined direction while contracting transverse to said predetermined direction.

5. A device as defined in claim 4, wherein said plug comprises rubber.

6. A device as defined in claim 4, wherein said plug has a pair of substantially parallel sides.

7. A device as defined in claim 4, wherein said plug resembles a cylinder.

8. A device as defined in claim 4, said plug having an outer end which is adapted to be located in the region of an open end of the passage; and wherein said outer end comprises a radially projecting, beveled portion.

9. A device as defined in claim 4, wherein said plug is provided with an axial venting channel.

10. A device as defined in claim 4, wherein the passage is arranged in a transportable element and is designed to anchor a lifting member for transporting and mounting the element.

11. A device as defined in claim 4, wherein the passage has an open end of predetermined cross-sectional area and a substantial portion of the passage has said predetermined cross-sectional area.

12. A device as defined in claim 4, wherein said plug has a longitudinal axis and said predetermined direction substantially parallels said axis.

13. A device as defined in claim 4, said plug having first and second ends which are spaced along said predetermined direction; and wherein said adjusting means engages said plug in the regions of said ends.

14. A device as defined in claim 4, said plug having an inner end which is adapted to be located internally of the passage; and wherein said inner end is contoured to facilitate insertion of said plug into the passage.

15. A device as defined in claim 14, wherein said inner end is beveled.

16. A device as defined in claim 4, wherein the passage has an open end of predetermined cross-sectional area greater than said predetermined cross-sectional area, said plug being adapted to be located in said portion of the passage, and said adjusting means being designed to expand said plug to a cross-sectional area greater than said predetermined cross-sectional area so as to seal the open end of the passage.

17. A device as defined in claim 16, wherein the portion of the passage having a cross-sectional area greater than said predetermined cross-sectional area is situated between a pair of components and said plug serves as a spacer for the components.

18. A device as defined in claim 17, wherein the components are walls.

19. A device as defined in claim 4, wherein said plug is adapted to be disposed in a mold for the production of an element from a flowable and hardenable material during hardening of the material and to be subsequently withdrawn from the material so as to expose a passage in the element.

20. A device as defined in claim 19, wherein the flowable and hardenable material comprises concrete.

21. A device as defined in claim 19, wherein the plug is adapted to be in direct contact with the flowable and hardenable material.

22. A device as defined in claim 19, wherein a supporting member is provided to maintain the position of said plug during hardening of the flowable and hardenable material and said plug has a retaining member which is adapted to engage the supporting member.

23. A device as defined in claim 22, wherein the supporting member is mounted on the mold.

24. A device as defined in claim 19, wherein the element comprises a hollow member which at least in part defines the passage in the element and said plug is adapted to project into and seal the hollow member during hardening of the flowable and hardenable material.

25. A device as defined in claim 24, wherein the hollow member extends in a direction which is generally perpendicular to a surface of the element.

26. A device as defined in claim 4, said adjusting means comprising an adjusting member for adjusting the cross-sectional area of said plug.

27. A device as defined in claim 26, said plug having an outer end which is adapted to be located in an region of the open end of the passage; and wherein said adjusting member engages said outer end.

28. A device as defined in claim 26, wherein said adjusting member is operative to compress said plug and thereby increase the cross-sectional area thereof.

29. A device as defined in claim 26, wherein said adjusting member has an external end which is adapted to be located in the region of the open end of an passage and said external end comprises an engaging member for engaging said adjusting member.

30. A device as defined in claim 29, wherein said engaging member comprises a ring.

31. A device as defined in claim 29, wherein said engaging member comprises a hook.

32. A device as defined in claim 26, said plug having an outer end which is adapted to be located in the region of an open end of the passage and an inner end which is adapted to be located internally of the passage; and wherein said adjusting member engages said plug in the regions of said outer and inner ends and is operative to lengthen and shorten said plug in axial direction thereof to thereby respectively reduce and increase the cross-sectional area of said plug.

33. A device as defined in claim 32, said adjusting means comprising a bearing member which connects said adjusting member and said plug.

34. A device as defined in claim 32, said adjusting member having threaded portions in the regions of said outer and inner ends; and wherein said adjusting means comprises threaded sleeves in the regions of said outer and inner ends receiving respective ones of said threaded portions.

35. A device as defined in claim 34, wherein said threaded sleeves are accommodated within the cross-section of said plug.

36. A device as defined in claim 34, wherein said adjusting member comprises a bolt.

37. A device as defined in claim 34, wherein said threaded portions and threaded sleeves are designed in such a manner that a predetermined rotation of said adjusting member causes said threaded portions to advance by different amounts.

38. A device as defined in claim 37, wherein the pitches of the respective sets of threaded portions and threaded sleeves are different.

39. A device as defined in claim 34, said plug having an outer end face adjacent said outer end and an inner end face adjacent said inner end; and wherein said threaded sleeves are connected with said plug in the regions of the respective end faces in such a manner as to permit tensile loads to be transmitted between said plug and said threaded sleeves.

40. A device as defined in claim 39, wherein said threaded sleeves have flanges and said flanges are connected with said plug.

41. A device as defined in claim 39, said plug comprising rubber; and wherein said threaded sleeves comprise metal and are connected with said plug by a rubber-to-metal bond.

42. A method of making an element having a passage comprising the steps of:

(a) surrounding a resilient plug with a flowable and hardenable material;

(b) hardening said material;

(c) forming a gap between said plug and said material by tensioning said plug so that the latter elongates in a predetermined direction while contracting transverse to said predetermined direction thereby defining said gap; and (d) withdrawing said plug from said material.

43. A method as defined in claim 42, wherein the surrounding step comprises directly contacting said plug with said material.

44. A method as defined in claim 42, wherein said material comprises concrete.

45. A method as defined in claim 42, said element including a hollow member; and further comprising the steps of inserting said plug into said hollow member prior to the surrounding step, and expanding said plug into engagement with said hollow member.

46. A method as defined in claim 42; further comprising the step of arresting said plug to prevent movement thereof during the hardening step.

47. A method as defined in claim 42, wherein the surrounding step comprises pouring said material around said plug.

48. A device for performing a supporting function in a passage having an open end of predetermined cross-sectional area, comprising a plug which is expandable to said predetermined cross-sectional area and contractible to a lesser cross-sectional area, said plug having a pair of substantially parallel sides, and a pair of semicircular sides which join said parallel sides.

49. A device as defined in claim 24, wherein said adjusting means is designed to expand said plug into engagement with the hollow member.

* * * * *